US005363998A

United States Patent [19]

Tschiderer

[11] Patent Number: 5,363,998

[45] Date of Patent: Nov. 15, 1994

[54] RESTACKING TRAY FOR FAN FOLD PAPER FEEDER

[75] Inventor: Paul E. Tschiderer, Geneseo, N.Y.

[73] Assignee: Eastman Kodak Company, Rochester, N.Y.

[21] Appl. No.: 898,664

[22] Filed: Jun. 15, 1992

[51] Int. Cl.[5] ..... B65H 31/22

[52] U.S. Cl. ..... 226/200; 271/207; 400/613.2

[58] Field of Search ..... 400/613.2; 206/449, 206/555; 220/408, 410; 226/200; 271/209, 207; 270/32, 39; 355/75

[56] References Cited

U.S. PATENT DOCUMENTS

| | | | |
|---|---|---|---|
| 2,638,211 | 5/1953 | Spurr | 206/449 |
| 3,178,172 | 4/1965 | Lettan | 270/79 |
| 4,707,156 | 11/1987 | Clark | 400/613.2 |
| 4,828,118 | 5/1989 | Dearien, Jr. | 211/50 |
| 4,860,904 | 8/1989 | Williams | 211/50 |
| 4,871,273 | 10/1989 | Fields | 400/613.2 |
| 4,944,386 | 4/1990 | Murata et al. | 206/449 X |
| 5,074,543 | 12/1991 | Lawniczak et al. | 271/207 |
| 5,099,996 | 3/1992 | Vallis | 400/613.2 X |

FOREIGN PATENT DOCUMENTS

| | | | |
|---|---|---|---|
| 0209174 | 11/1984 | Japan | 400/613.2 |

OTHER PUBLICATIONS

IBM Tech. Disclosure Bulletin, vol. 23, No. 3, Gunnell, Aug. 1980.

*Primary Examiner*—Daniel P. Stodola
*Assistant Examiner*—John P. Darling
*Attorney, Agent, or Firm*—Lawrence P. Kessler

[57] ABSTRACT

A tray for use with a mechanism for feeding fan fold paper along a predetermined travel path. The tray comprises an upstanding wall member and a floor member located in juxtaposition with the upstanding wall member. The floor member has a first portion forming an acute included angle with the upstanding wall member, and a second portion connected to the first portion opposite the upstanding wall member and intersecting the first portion at an obtuse angle.

5 Claims, 4 Drawing Sheets

RESTACKING TRAY FOR FAN FOLD PAPER FEEDER

BACKGROUND OF THE INVENTION

The present invention relates, in general, to devices for handling fan fold paper, and more particularly, to a tray for restacking fan fold paper fed along a predetermined travel path by a fan fold paper handling device.

It is common practice to print information from a computer on an elongated run of paper, typically referred to as continuous or fan fold paper. Fan fold paper, as is well known in the art, is a continuous strip of paper having regularly spaced perforations along its longitudinal marginal edges to facilitate transport of the paper strip, and transverse alternating folds at predetermined intervals to establish substantially equal sized individual panels which can be folded upon one another to form a neat compact stack. Recent electrostatographic reproduction apparatus have been designed with the capability of copying information contained on either individual documents or fan fold paper. An example of such apparatus is shown in U.S. Pat. No. 5,074,543 (issued Dec. 24, 1991, in the name of Lawniczak et al). In such apparatus, a motor driven tractor assembly is utilized to transport the fan fold paper such that it is fed along a predetermined travel path from a stack supported in a supply hopper across the platen of the reproduction apparatus and then deposited in a tray for restacking. At appropriate times, the reproduction apparatus is activated in a well known manner to copy information from the individual panels of the fan fold paper.

SUMMARY OF THE INVENTION

In view of the foregoing discussion, this invention is directed to a fan fold paper restacking tray for use with a device for feeding fan fold paper along a predetermined travel path. The tray comprises an upstanding wall member and a floor member located in juxtaposition with the upstanding wall member. The floor member has a first portion forming an acute included angle with the upstanding wall member, and a second portion connected to the first portion opposite the upstanding wall member and intersecting the first portion at an obtuse angle.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
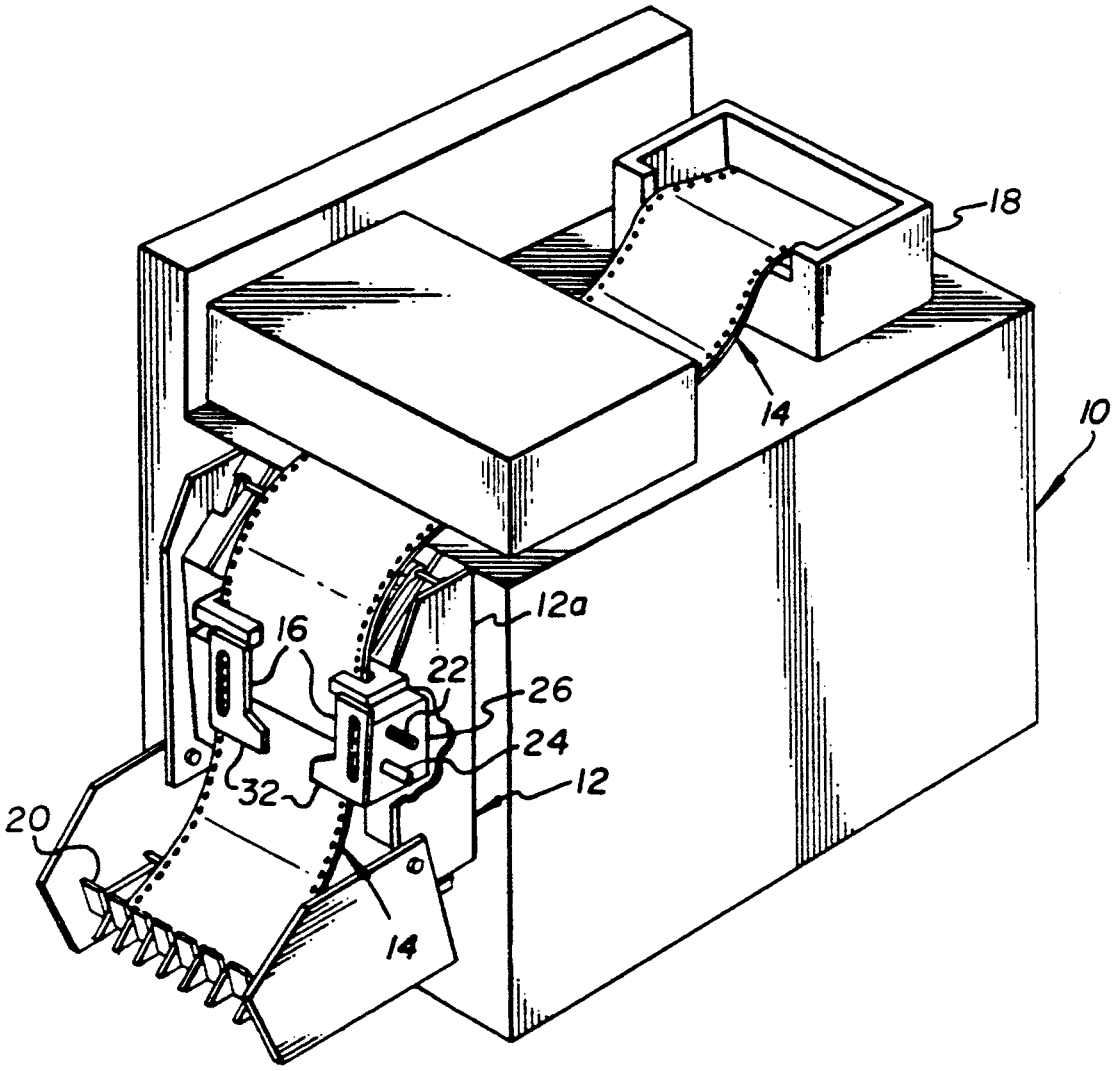
FIG. 1 is a view, in perspective, of a reproduction apparatus including a device for feeding fan fold paper in a manner such that the individual panels thereof may be copied, with a portion thereof broken away to facilitate viewing.

Referring now to the accompanying drawings, FIG. 1 shows in generally schematic form an exemplary reproduction apparatus 10 which includes a device 12 for feeding fan fold paper 14 (as defined above) in a manner such that information contained thereon may be copied. Such fan fold paper feeding device 12, which is more fully shown and described in the aforementioned U.S. Pat. No. 5,074,543, includes a motor driven tractor drive assembly 16 for effecting transport of the fan fold paper 14 from a stack in a supply hopper 18 into association with the reproduction apparatus (such that the information on the individual panels thereof may be copied), and then to an output tray 20 where the fan fold paper is restacked.

The tractor drive assembly 16 includes spaced shafts 22 and 24 supported in a frame 12*a* of the fan fold paper feeding device 12. A pair of housings 26 (only one shown in FIG. 1) are adjustably mounted on the spaced shafts 22 and 24 for movement along the longitudinal axes of the shafts. The adjustability of the housings 26 in the longitudinal direction along the axes of the shafts 22 and 24 serves to enable the tractor drive assembly 16 to be located to accommodate various widths (measured in the cross-track direction) of the fan fold paper.

As is well known, the tractor drive assembly 16 further includes closed loop tractor chains respectively located within the housings 26. The tractor chains respectively have a plurality of pins extending substantially outwardly therefrom. The pins of each tractor chain are spaced apart a distance corresponding to the standard distance between adjacent marginal edge perforations in fan fold paper. Hold down clips 32 are respectively attached to the housings 26 for pivotable movement. The hold down clips are manually movable to a closed position (as shown in FIG. 1) to retain fan fold paper on the pins of the tractor chains, and to an open position where the pins are readily accessible such that the fan fold paper is readily threadable onto the pins.

After the fan fold paper is threaded onto the pins, the hold down clips are moved to the closed position to retain the fan fold paper in operative relation with the pins. Thus, when the tractor chains are driven, the fan fold paper is advanced thereby in discrete intervals to advance individual panels thereof from the stack in the supply hopper 18 into association with the image capture station (not shown) of the reproduction apparatus 10 to enable such individual panels to be copied. Thereafter, the fan fold paper 14 is advanced to the output tray 20 for restacking.

Figure 2:
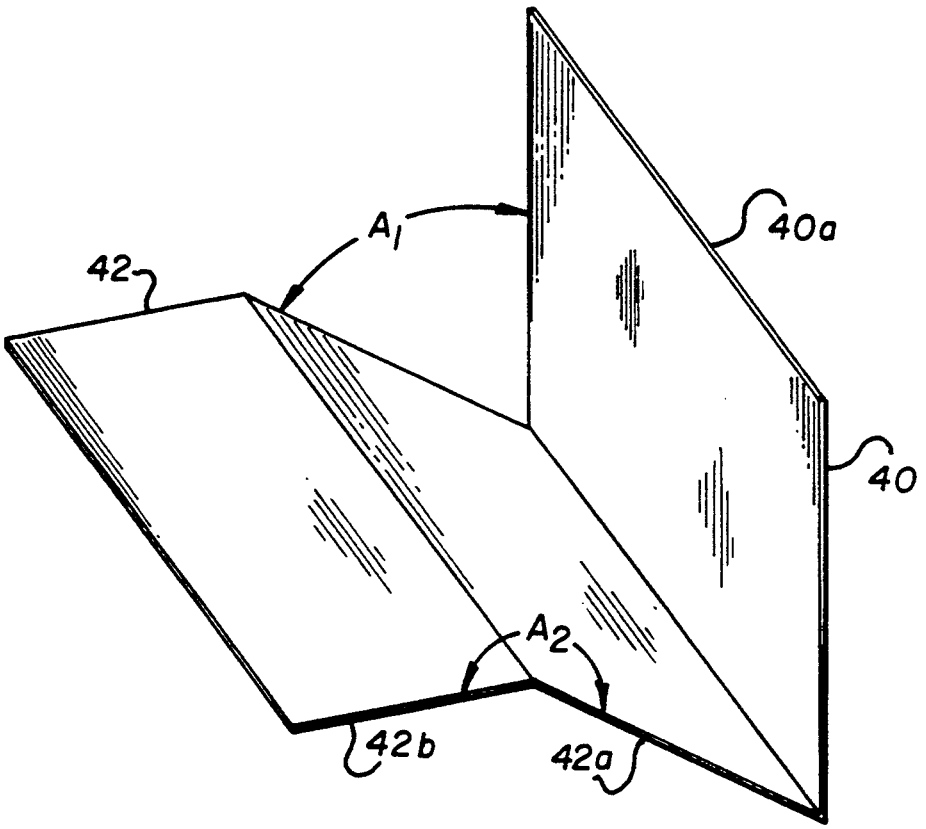
FIG. 2 is a view, in perspective, of the restacking tray, according to this invention, for the fan fold paper feeding device of FIG. 1.

The restacking tray 20, according to this invention, is particularly configured to assure that the fan fold paper is restacked into a neat compact pile as found in the supply hopper 18. The restacking tray 20, as best seen in FIG. 2, includes an upstanding wall member 40. The upstanding wall member 40 extends toward the tractor drive assembly 16. The top edge 40*a* of the upstanding wall member 40 is spaced from the tractor drive assembly 16 a predetermined distance, designated by the letter D in FIG. 3*a*, selected to be less than the minimum width of an individual panel of the fan fold paper 14 measured in the direction of travel of the fan fold paper along its travel path. For example, a typical minimum width of a panel of fan fold paper is 20 cm. Accordingly, the edge 40*a* is spaced from the tractor drive assembly by a distance of approximately 17.5 cm.

The restacking tray 20 also includes a floor member 42 located in juxtaposition with the upstanding wall member 40. The floor member 42 has a first portion 42*a* and a second portion 42*b*. The first portion 42*a* forms an acute included angle $A_1$ with said upstanding wall member. The angle $A_1$ is preferably in the range of about 60°–70°, and most ideally approximately 65°. The second portion 42*b* is connected to the first portion 42*a* opposite the upstanding wall member 40 and intersects the first portion at an obtuse angle $A_2$. The angle $A_2$ is preferably approximately 195°.

Figure 3A:
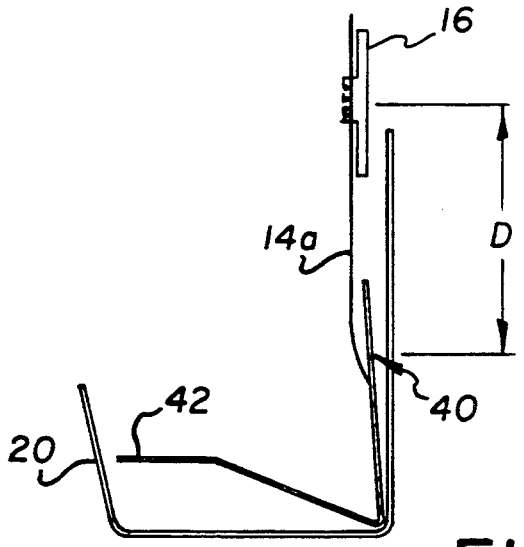
FIGS. 3*a*–3*e* are side elevational views of restacking tray and a portion of the fan fold feeding device at sequential times during the restacking operation for the fan fold paper.
Figure 3B:
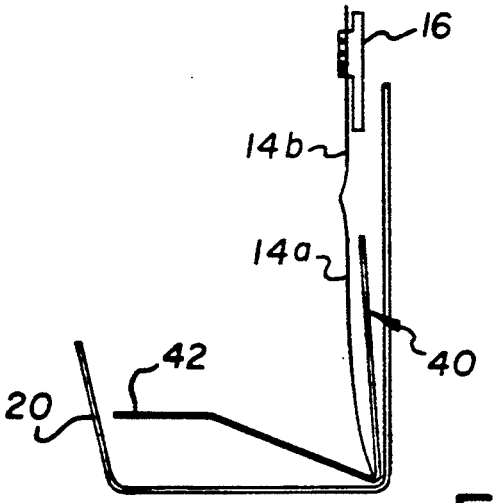

Restacking of the fan fold paper 14 in a neat compact pile in the restacking tray 20 is accomplished because of the particular described configuration, according to this invention, for the restacking tray. Restacking occurs as follows: As shown in FIG. 3*a*, the first panel 14*a* of the fan fold paper 14 has an inward curl at its lead edge. The lead edge of the first panel 14*a*, while such panel is still under the control of the tractor drive assembly 16, contacts the upstanding wall member 40 and is constrained to slide down the wall member as the fan fold paper is transported along its travel path by the tractor drive assembly. Because the upstanding wall member 40 is spaced at the specified distance D from the tractor drive assembly 16, even the minimum width panel of the fan fold paper will contact the upstanding wall member and be so constrained. The lead edge of the first panel 14*a* will eventually be brought into engagement with the first portion 42*a* of the floor member 42 at the intersection of such first portion with the upstanding wall member 40 (see FIG. 3*b*).

Figure 3C:
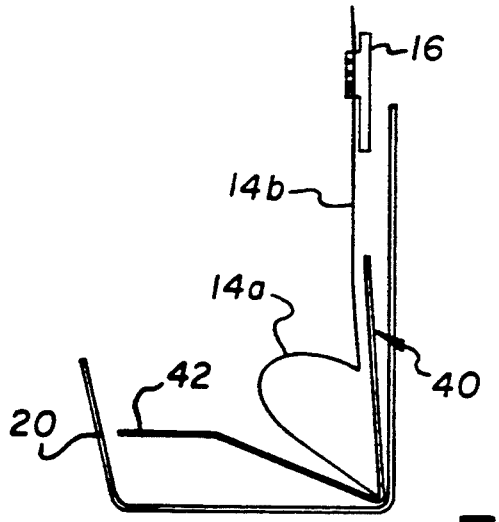
Figure 3D:
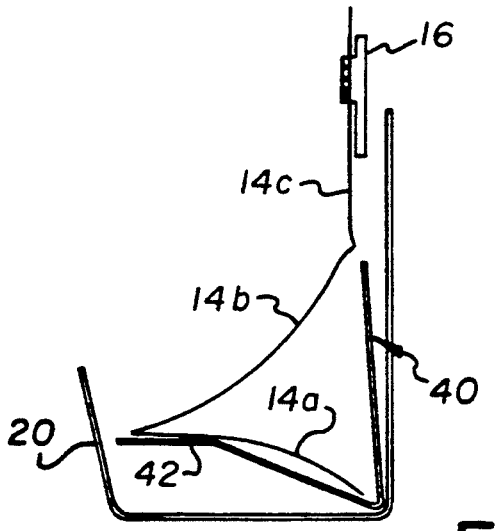
Figure 3E:
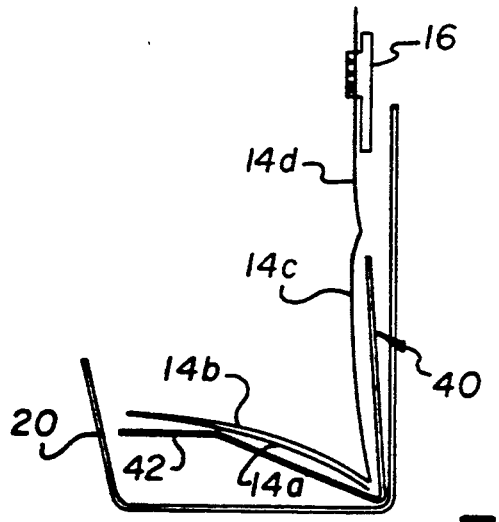

With the lead edge of the first panel 14*a* constrained within the acute angle formed between the upstanding wall member 40 and the first portion 42*a* of the floor member 42, continued transport of the fan fold paper 14 by the tractor drive assembly 16 (acting on second panel 14*b*) causes the first panel 14*a* to take the form of a flat spring which is bent (see FIG. 3*c*) to store energy therein as a spring force. When the spring force of the first panel 14*a* exceeds the drive force on the second panel 14*b*, the first panel will snap into a substantially horizontal rest position on the floor member 42, carrying the second panel therewith (see FIG. 3*d*). The third panel 14*c*, urged in the fan fold paper travel path by the tractor drive assembly 16, drives the second panel 14*b* into its rest position, while the fourth panel 14*d* drives the third panel 14*c* toward engagement with the intersection of the upstanding wall member and the floor member (see FIG. 3*e*). The obtuse angle $A_2$ formed by the intersection of the first portion 42*a* and the second portion 42*b* of the floor member 42 assures that the panels in the rest position on the floor member will neatly stack and remain in juxtaposition with the upstanding wall 40. This stacking process is repeated for the subsequent panels of the fan fold paper 14 until all the panels are neatly and compactly restacked.

The invention has been described in detail with particular reference to preferred embodiments thereof, but it will be understood that variations and modifications can be effected within the spirit and scope of the invention as set forth in the claims.

What is claimed is:

1. A mechanism for feeding fan fold paper in a generally vertical downward direction, which fan fold paper has spaced transverse alternating folds, first and second opposite sides, and a tendency of the leading edge of the paper adjacent to every other transverse alternating fold to curl toward the first side, said mechanism comprising:

a tray for stacking such fan fold paper, said tray said tray including an upstanding wall member defining a vertically oriented wall positioned to engage the leading edge of the paper with the first side and the curl of the paper toward the wall, and a floor member forming an acute angle corner with said upstanding wall member, said angle being sufficiently acute to maintain the leading edge of the paper in the corner as the paper is driven downward by a drive means forcing the paper to bend away from said upstanding wall member and stack neatly with respect to the corner with the second side of the paper resting on the floor member.

2. The fan fold paper restacking tray of this invention according to claim 1 wherein said upstanding wall member extends toward said fan fold paper feeding mechanism sufficiently that the leading edge of the paper engages the wall before the next fold leaves the feeding mechanism.

3. The fan fold paper restacking tray of this invention according to claim 1 wherein said acute angle is in the range of 60°–70°.

4. The fan fold paper restacking tray of this invention according to claim 3 wherein said acute angle is approximately 65°.

5. The fan fold paper restacking tray of this invention according to claim 1 & 2 wherein said floor member has first and second floor portions, said first portion cooperating with the vertically oriented wall to form the acute angle corner and said second portion of said floor member intersecting said first portion at an obtuse angle.

* * * * *